United States Patent [19]

Aspart et al.

[11] Patent Number: 4,481,135

[45] Date of Patent: Nov. 6, 1984

[54] PROCESS FOR THE TREATMENT OF BASIC AQUEOUS EFFLUENTS

[75] Inventors: Alain Aspart, Paris; Bernard Guillaume, Grigny; Jean-Paul Moulin, Bois d'Arcy, all of France

[73] Assignee: Commissariat A L'Energie Atomique, Paris, France

[21] Appl. No.: 389,281

[22] Filed: Jun. 17, 1982

[30] Foreign Application Priority Data

Jun. 24, 1981 [FR] France ..... 81 12408

[51] Int. Cl.[3] ..... G21F 9/08

[52] U.S. Cl. ..... 252/632; 159/DIG. 12; 423/251

[58] Field of Search ..... 252/632, 631 A, 626, 252/627, 634; 159/DIG. 12, DIG. 16; 423/251

[56] References Cited

U.S. PATENT DOCUMENTS

| | | | |
|---|---|---|---|
| 3,280,887 | 10/1966 | Charuit et al. | 159/DIG. 12 |
| 3,361,649 | 1/1968 | Karter | 252/632 |
| 4,108,718 | 8/1978 | Rickey, Jr. et al. | 159/DIG. 16 |
| 4,197,197 | 4/1980 | Oschenfeld et al. | 210/638 |

FOREIGN PATENT DOCUMENTS

| | | | |
|---|---|---|---|
| 1228099 | 11/1966 | Fed. Rep. of Germany . | |
| 23900 | 2/1979 | Japan | 252/631 |
| 2027257 | 2/1980 | United Kingdom . | |

*Primary Examiner*—Benjamin R. Padgett
*Assistant Examiner*—Howard J. Locker
*Attorney, Agent, or Firm*—Pearne, Gordon, Sessions, McCoy, Granger & Tilberry

[57] ABSTRACT

The invention relates to a process for the treatment of basic aqueous effluents containing plutonium and possibly uranium.

According to this process, the effluents are concentrated by evaporation under reduced pressure, at a temperature such that plutonium precipitation is substantially avoided. Advantageously, the effluents are evaporated at a temperature of 50° to 80° C. for a time such that a concentration factor of at least 6 is obtained.

Application to the treatment of aqueous effluents obtained by the alkaline washing of organic solvents used in installations for the reprocessing of irradiated nuclear fuels.

8 Claims, No Drawings

PROCESS FOR THE TREATMENT OF BASIC AQUEOUS EFFLUENTS

BACKGROUND OF THE INVENTION

The present invention relates to a process for the treatment of basic aqueous effluents containing plutonium and possibly uranium, which can in particular be used for treating aqueous effluents obtained by the alkaline washing of organic solvents used in installations for the reprocessing of irradiated nuclear fuels.

In installations for the reprocessing of irradiated nuclear fuels, organic solvents are normally used for extracting the plutonium and uranium from nitric solutions for dissolving the irradiated fuels. Following this extraction stage in the organic solvent, the uranium and plutonium are recovered by selective re-extraction in aqueous solutions. The organic solvent is then treated to purify and decontaminate it before recycling it in the uranium and plutonium extraction stage.

In general, the purification treatment of the solvent comprises an alkaline washing stage performed, for example, by means of a sodium carbonate solution. When the solvent is tributyl phosphate, the alkaline washing stage using a sodium carbonate solution makes it possible, on the one hand, to extract in the aqueous solution, dibutyl phosphoric acid [$(DBP^-H^+)$], which is the main degradation product of tributyl phosphate and, on the other hand, maintain in aqueous solution the heavy metal ions and in particular uranium, zirconium and especially plutonium, due to the complexing properties of the carbonate ion.

Thus, at the end of the alkaline washing stage, radioactive effluents are obtained, which contain in solution traces of plutonium and uranium. In order to ensure the subsequent treatment of these radioactive effluents, under good conditions, it is preferable to concentrate them by evaporation in order to in this way reduce the volume of effluents to be treated.

However, concentration by evaporation at atmospheric pressure of effluents of this type suffers from a major disadvantage. During evaporation, there is a partial, but relatively large precipitation (approx. 50%) of the plutonium which was initially in solution, which is rather hazardous due to the possibility of an accumulation of a critical amount of plutonium both in the evaporator and in the means for the storage and transportation of the concentrated effluents.

BRIEF SUMMARY OF THE INVENTION

The present invention relates to a process for the treatment of basic aqueous effluents containing plutonium and possibly uranium making it possible to reduce the volume of these effluents, whilst substantially obviating any precipitation of the plutonium.

Thus, according to the invention, the effluents are concentrated by evaporation under reduced pressure at a temperature such that plutonium precipitation is substantially prevented.

Advantageously, evaporation takes place at a temperature below 80° C., e.g. at between 50° and 80° C.

By concentrating the effluents by heating under reduced pressure in accordance with the present invention, it is possible to obtain evaporation, whilst limiting the temperature of the solution, so as to substantially prevent plutonium precipitation.

Thus, experiments carried out on different plutonium solutions in a carbonate medium have demonstrated that plutonium precipitation during evaporation did not result from a saturation of the solution, but was in fact due to the effect of the temperature used for bringing about this evaporation.

As is demonstrated by the results of the following table 2, the solubility of the plutonium in carbonate solutions at ambient temperature is well above the plutonium concentration which can be achieved in basic aqueous effluents concentrated by evaporation under atmospheric pressure.

Moreover, experiments carried out by heating plutonium solutions in a carbonate medium to different temperatures for predetermined periods have shown that the precipitation of plutonium was mainly dependent on the temperature. The results of these experiments are given in table 2 for two solutions called solution I and solution II, solution I having an initial $NaHCO_3$ content of 0.4 M and was raised to each temperature for a period of 2 hours, and solution II having an initial $NaHCO_3$ content of 0.4 M and $Na_2CO_3$ content of 0.44 M, whilst being heated to each temperature for 4 hours.

Thus, the solubility of plutonium in a carbonate medium decreases considerably when the temperature reaches 90° C., which is probably due to the fact that the temperature rise aids the displacement of plutonium from its carbonate complexes by hydrolysis. Moreover, the dissolving rate of the thus formed plutonium precipitate is doubtless too slow when cold in the carbonate solutions. This does not make it possible to ensure redissolving the precipitated plutonium.

Thus, by limiting in accordance with the present invention the temperature used during evaporation, it is possible to substantially prevent precipitation of the plutonium leading to concentrated plutonium solutions.

The process of the invention is more particularly applicable to the treatment of aqueous effluents containing sodium carbonate and optionally sodium hydrogen carbonate and sodium nitrate.

According to the invention, evaporation advantageously takes place under a reduced pressure by heating the solution for a period such that an effluent concentration factor of at least 6 is obtained.

Other advantages and features of the invention can be gathered from the following non-limitative examples.

EXAMPLE 1

This examples relates to the treatment of basic aqueous effluents having the following composition:

$[Na^+]=0.5$ M; $[CO_3^2]=0.013$ M; $[HCO_3^-]=0.38$; $[NO_3^-]=0.1$ M; $[Pu]=85$ mg/l; $[U]=1.03$ g/l$^{-1}$; $[DBP^-]=1$ g/l

These effluents are concentrated by operating at a temperature of 58° C. under a pressure of 67,500 Pa, evaporation being continued until different concentration factors are obtained.

In each case, the uranium and plutonium quantities are measured, these being in the form of a precipitate and a solution.

The results obtained are given in Table 3. It can be seen that for a concentration factor of 6, there is no plutonium precipitation. In the case of a concentration factor substantially equal to 6, the concentrated solution composition is approximately as follows:

$[Pu]=0.56$ g/l; $[U]=6.4$ g/l$^{-1}$; $[DBP^-]=6$ g/l$^{-1}$ $[Na^+]=3$ M

Finally, it can be seen that when evaporation is continued until a concentration factor of 8 is obtained, the precipitated plutonium quantity only represents about 1% of the total plutonium.

EXAMPLE 2

This examples relates to the treatment of basic aqueous effluents having the following composition:

$[Na^+]=0.6$ M=; $[CO_3^{2}]=0.11$ M; $[HCO_3^-]=0.21$ M; $[NO_3^-]\simeq 0.2$ M; [Pu]=0.37 mg/l; [U]=1.87 g/l [DBP]≃10 g/l This solution is concentrated by evaporation, whilst operating under a pressure of 70875 Pa and a temperature of 60° C. Evaporation is continued until concentration factors between 2 and 8 are obtained.

For these different concentration factors, the plutonium and uranium contents present in the form of precipitate and solution are determined. The results obtained are given in the attached Table 4. They show that a concentration factor of 6 can be reached without there being any plutonium precipitate formation.

The concentration of the solution corresponding to the concentration factor of 6 is approximately as follows:

[Pu]=2.2 mg/l; [U]=5.3 g/l; $[DBP^-]-60$ g/l; $[Na^+]=3$ M

As hereinbefore, for a concentration factor of 8, the precipitated plutonium quantity is only about 1% of the total plutonium.

EXAMPLE 3

This example relates to the treatment of basic effluents obtained during the experimental reprocessing of nuclear fuels of the PWR type (Borselle) in the Cyrano chain. These effluents have the following composition:

$[Na^+]\simeq 0.86$ M; $[CO_3^{2}]=0.163$ M; $[HCO_3^-]=0.045$ M; $[NO_3^-]\simeq 0.5$ M; [U]=1.52 g/l; [Pu]=8.0 mg/l; [DBP]≃60 mg/l They have a $\beta\gamma$ activity of 100 μCi/l.

These effluents are separated into two batches and the first batch is concentrated by an evaporation at atmospheric pressure and the second batch is concentrated by evaporation under a reduced pressure, using a pressure of 72900 Pa and a temperature of 62° C.

For the first batch, evaporation is continued until concentration factors between 1 and 6 are obtained, whilst for the second batch evaporation is continued until concentration factors between 1 and 12 are obtained.

As hereinbefore, the uranium and plutonium contents of the solutions, as well as the uranium and plutonium contents of the precipitates are measured. The results obtained with the first and second batches are respectively given in the attached tables 5 and 6. It can be seen that when operating under atmospheric pressure, the precipitation of the plutonium takes place no matter what the concentration factor and affects 40 to 50% of the total plutonium.

However, when evaporation is performed under reduced pressure, there is no plutonium precipitation until a concentration factor of 8 is reached. It is pointed out that the composition of the concentrated solution corresponding to a concentration factor of 8 is approximately as follows:

[Pu]=83 mg/l=[U]=12 g/l; $[DBP^-]=0.48$ g/l; $[Na^+]=6.9$ M

Its $\beta\gamma$ activity is 0.8 mCi/l.

When the concentration factor reached 10, a slight precipitate is formed. However, the latter contains no plutonium, whilst allowing for the precision of the measurements. Finally, for a concentration factor of 12, the precipitate formed contains 6% of the total plutonium.

Thus, concentrating the effluents by evaporation under a reduced pressure and at a temperature below 80° C. in accordance with the present invention, makes it possible to concentrate these effluents until a concentration factor of at least 6 is obtained, without there being any plutonium precipitation.

It would appear that the precipitation which then occurs is probably due to uranium saturation of the solution, the latter element probably entraining the plutonium in its precipitation.

TABLE 1

| $Na^+$ (M) | $NO_3^-$ (M) | $CO_3^{--}$ (N) | $HCO_3^-$ (N) | Total $Co_2$ (M) | pH* found | pH* calc. | Soluble Pu (g/l) |
|---|---|---|---|---|---|---|---|
| 1 | 0.19 | 0.68 | 0.13 | 0.47 | 10.36 | 10.86 | 3.74 |
| 1 | 0.28 | 0.50 | 0.22 | 0.47 | 9.90 | 10.37 | 6.71 |
| 1 | 0.41 | 0.23 | 0.36 | 0.475 | 9.13 | 9.57 | 7.56 |
| 1 | 0.15 | 0.16 | 0.69 | 0.77 | 7.80 | 8.17 | 11.70 |
| 1 | 0.68 | 0.05 | 0.27 | 0.295 | 7.60 | 8.65 | 3.06 |
| 0.282 | 0.117 | 0.020 | 0.145 | 0.155 | 8.65 | 8.65 | 0.97 |
| 0.372 | 0.107 | 0.040 | 0.225 | 0.245 | 8.90 | 8.90 | 2.84 |
| 0.563 | 0.123 | 0.160 | 0.280 | 0.360 | 9.30 | 9.30 | 3.60 |
| 0.743 | 0.103 | 0.280 | 0.360 | 0.500 | 9.65 | 9.65 | 6.83 |
| 1.125 | 0.105 | 0.560 | 0.460 | 0.740 | 9.60 | 10.30 | 6.33 |
| 1.485 | 0.095 | 0.820 | 0.570 | 0.980 | 9.65 | 10.95 | 8.44 |
| 2.250 | 0.110 | 1.280 | 0.860 | 1.500 | 9.60 | 11.83 | 8.08 |

*In the sodium medium, the pH details for the electrodes suffer from errors. The above table gives the calculated and found pH on the basis of a calibration.

TABLE 2

| T° | 20° C. | 50° C. | 60° C. | 70° C. | 80° C. | 90° C. | 95° C. | 100° C. |
|---|---|---|---|---|---|---|---|---|
| | | Solution I - time 2 hours | | | | | | |
| Soluble Pu mg/l | 95 | 91.9 | 96.2 | 91.7 | 93.7 | 84.7 | 56.0 | 2.3 |
| % Precipitated Pu | 0 | 0 | 0 | 0 | 0 | 11 | 41 | 97.6 |
| | | Solution II - time 4 hours | | | | | | |
| Soluble Pu g/l | 5.48 | 5.42 | 5.49 | 5.43 | 5.18 | 4.66 | 3.49 | 0.085 |
| % precipitated Pu | 0 | 0 | 0 | 0 | 5.5 | 15 | 36 | 98.4 |

TABLE 3

| Concentration factor | 1 | −2 | −4 | −6 | −8 |
|---|---|---|---|---|---|
| Soluble Pu mg/l | 85 | 185 | 375 | 546 | 765 |
| % precipitated Pu | 0 | 0 | 0 | 0 | 1.02 |
| Dissolved U g/l | 1.03 | 2.2 | 3.6 | 6.4 | 8.8= |
| % precipitated U | 0 | 0 | 0 | 0 | 1.6 |
| Total boiling time | 0 | 2h20 | 7h05 | 12h20 | 17h40 |

TABLE 4

| Concentration factor | 1 | −2 | −4 | −6 | −8 |
|---|---|---|---|---|---|
| Soluble Pu mg/l | 0.37 | 0.71 | 1.07 | 1.575 | 1.495 |
| % precipitated Pu | 0 | 0 | 0 | 0 | 1.02 |
| Dissolved U $g/l^{-1}$ | 1.87 | — | — | — | 7.25 |
| % precipitated U | 0 | 0 | 0 | 0 | 7.6 |
| Total boiling time | 0 | 2h10 | 7h10 | 16h10 | 21h10 |

TABLE 5

| Concentration factor | 1 | −2 | −4 | −6 |
|---|---|---|---|---|
| Soluble Pu mg/l | 8.0 | 7.75 | 17.1 | 29.3 |
| % precipitated Pu | 0 | 47 | 44 | 41.8 |
| Dissolved U g/l | 1.52 | 2.80 | 5.83 | 9.8 |
| % precipitated U | 0 | — | — | — |
| Total boiling time | 0 | 6h30 | 19h00 | 32h50 |

TABLE 6

| Concentration factor | 1 | −2 | −4 | −6 | −8 | −10 | −12 |
|---|---|---|---|---|---|---|---|
| Soluble Pu mg/l | 8 | 13.9 | 31 | 45.6 | 61.5 | 83.3 | 98.4 |
| % precipitated Pu | 0 | 0 | 0 | 0 | 0 | 0 | 6.4 |
| Dissolved U g/l | 1.52 | 3.0 | 6.2 | 9.4 | 12.1 | 15.9 | 18.8 |
| % precipitated U | 0 | 0 | 0 | 0 | 0 | 0 | — |
| Total boiling time | 0 | 2h20 | 7h00 | 12h00 | 17h35 | 23h40 | 29h50 |

What is claimed is:

1. A process for the treatment of basic aqueous effluents containing in dissolved form one or more members selected from the group consisting of plutonium and mixtures of plutonium and uranium, wherein the effluents are basic aqueous solutions concentrated by evaporation under reduced pressure at a temperature such that precipitation of the plutonium is substantially avoided.

2. A process according to claim 1, wherein the effluents are evaporated at a temperature below 80° C.

3. A process according to claims 1 or 2, wherein the effluents contain sodium carbonate.

4. A process according to claims 1 or 2, wherein the effluents contain sodium hydrogen carbonate.

5. A process according to claims 1 or 2, wherein the effluents contain sodium nitrate.

6. A process according to claim 1, wherein the evaporation carried out by boiling under reduced pressure makes it possible to reach a concentration factor of at least 6.

7. A process according to claim 1, wherein the effluents are evaporated at a temperature in the range from about 50° C. to about 80° C.

8. A process according to claim 1, wherein the effluents have a pH in the range of from about 7.60 to about 10.36.

* * * * *